US008156910B2

(12) United States Patent
Clever et al.

(10) Patent No.: US 8,156,910 B2
(45) Date of Patent: Apr. 17, 2012

(54) CONCENTRIC CAMSHAFT AND METHOD OF ASSEMBLY

(75) Inventors: Glenn E. Clever, Washington, MI (US); Roy Glenn Kaywood, Jackson, MI (US); Ronald Hendrick, Parma, MI (US)

(73) Assignee: GM Global Technology Operations LLC

( * ) Notice: Subject to any disclaimer, the term of this patent is extended or adjusted under 35 U.S.C. 154(b) by 468 days.

(21) Appl. No.: 12/389,813

(22) Filed: Feb. 20, 2009

(65) Prior Publication Data

US 2010/0212144 A1 Aug. 26, 2010

(51) Int. Cl.
*F01L 1/04* (2006.01)

(52) U.S. Cl. ..... 123/90.6; 123/90.16; 29/888.1

(58) Field of Classification Search ..... 123/90.6, 123/90.16; 29/888.1
See application file for complete search history.

(56) References Cited

U.S. PATENT DOCUMENTS 4,835,832 A * 6/1989 Arnold et al. ..... 29/888.1
2002/0170514 A1* 11/2002 Methley ..... 123/90.16
* cited by examiner

*Primary Examiner* — Zelalem Eshete
(74) *Attorney, Agent, or Firm* — Harness, Dickey & Pierce, P.L.C.

(57) ABSTRACT

A camshaft assembly method may include locating a first lobe member of a camshaft assembly on a first shaft of the assembly. A locking pin may be inserted into a first radial bore in the first lobe member and a second radial bore of the first shaft. The locking pin may have an annular wall defining a pin bore extending from a first end of the locking pin to a second end of the locking pin. A deforming member may be forced into the pin bore to displace the annular wall in an outward radial direction and into a frictional engagement with the first radial bore. The forcing may include a deforming member entering the pin bore at the first end of the locking pin and exiting the pin bore at the second end of the locking pin.

20 Claims, 5 Drawing Sheets

CONCENTRIC CAMSHAFT AND METHOD OF ASSEMBLY

FIELD

The present disclosure relates to engine camshaft assemblies.

BACKGROUND

This section provides background information related to the present disclosure which is not necessarily prior art.

Engines typically include a camshaft to actuate intake and exhaust valves. Some camshafts are concentric camshafts that provide for relative rotation between, for example, the intake and exhaust lobes. The intake lobes may be fixed to an outer shaft for rotation with the shaft and the exhaust lobes may be rotatably supported on the shaft. Alternatively, the exhaust lobes may be fixed to the outer shaft for rotation with the shaft and the intake lobes may be rotatably supported on the shaft. In any arrangement, the lobes that are rotatably supported on the outer shaft may be rotationally fixed to the inner shaft using a fastener.

SUMMARY

This section provides a general summary of the disclosure, and is not comprehensive of its full scope or all of its features.

A camshaft assembly method may include locating a first lobe member of a camshaft assembly on a first shaft of the assembly. A locking pin may be inserted into a first radial bore in the first lobe member and a second radial bore of the first shaft. The locking pin may have an annular wall defining a pin bore extending from a first end of the locking pin to a second end of the locking pin. A deforming member may be forced into the pin bore to displace the annular wall in an outward radial direction and into a frictional engagement with the first radial bore. The forcing may include a deforming member entering the pin bore at the first end of the locking pin and exiting the pin bore at the second end of the locking pin.

The locking pin may be hollow after the deforming member is forced through the pin bore.

A camshaft assembly may include a first shaft having a first radial bore, a first lobe member located on the first shaft and including a second radial bore aligned with the first radial bore, and a locking pin. The locking pin may be located within the first and second radial bores. The locking pin may include an annular body defining a generally hollow longitudinal bore extending from a first longitudinal end of the locking pin to a second longitudinal end of the locking pin. The first and second longitudinal ends may be frictionally engaged with the first lobe member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
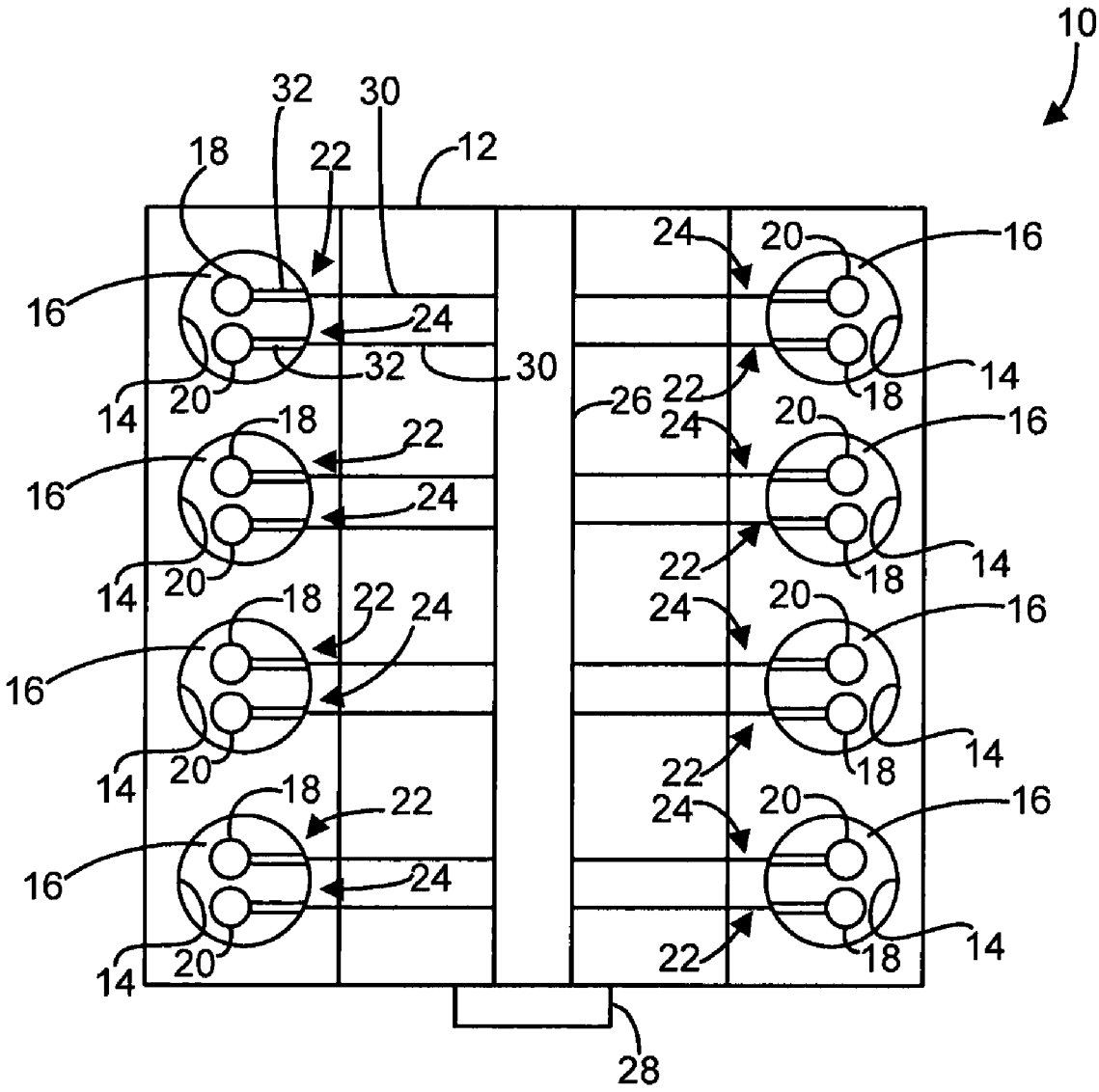
FIG. 1 is a schematic illustration of an engine assembly according to the present disclosure.
Figure 2:
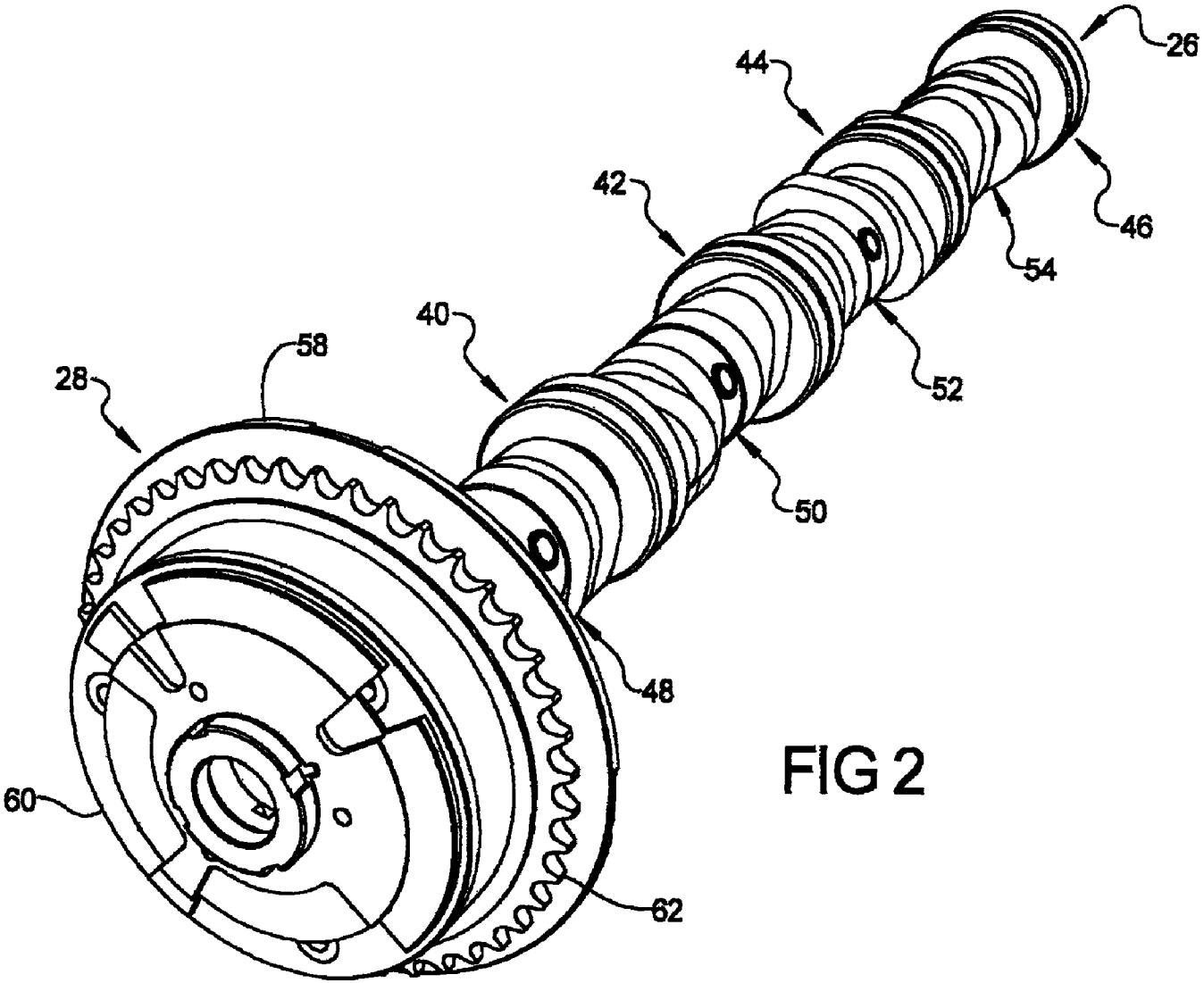
FIG. 2 is a perspective view of the camshaft and cam phaser of FIG. 1.
Figure 3:
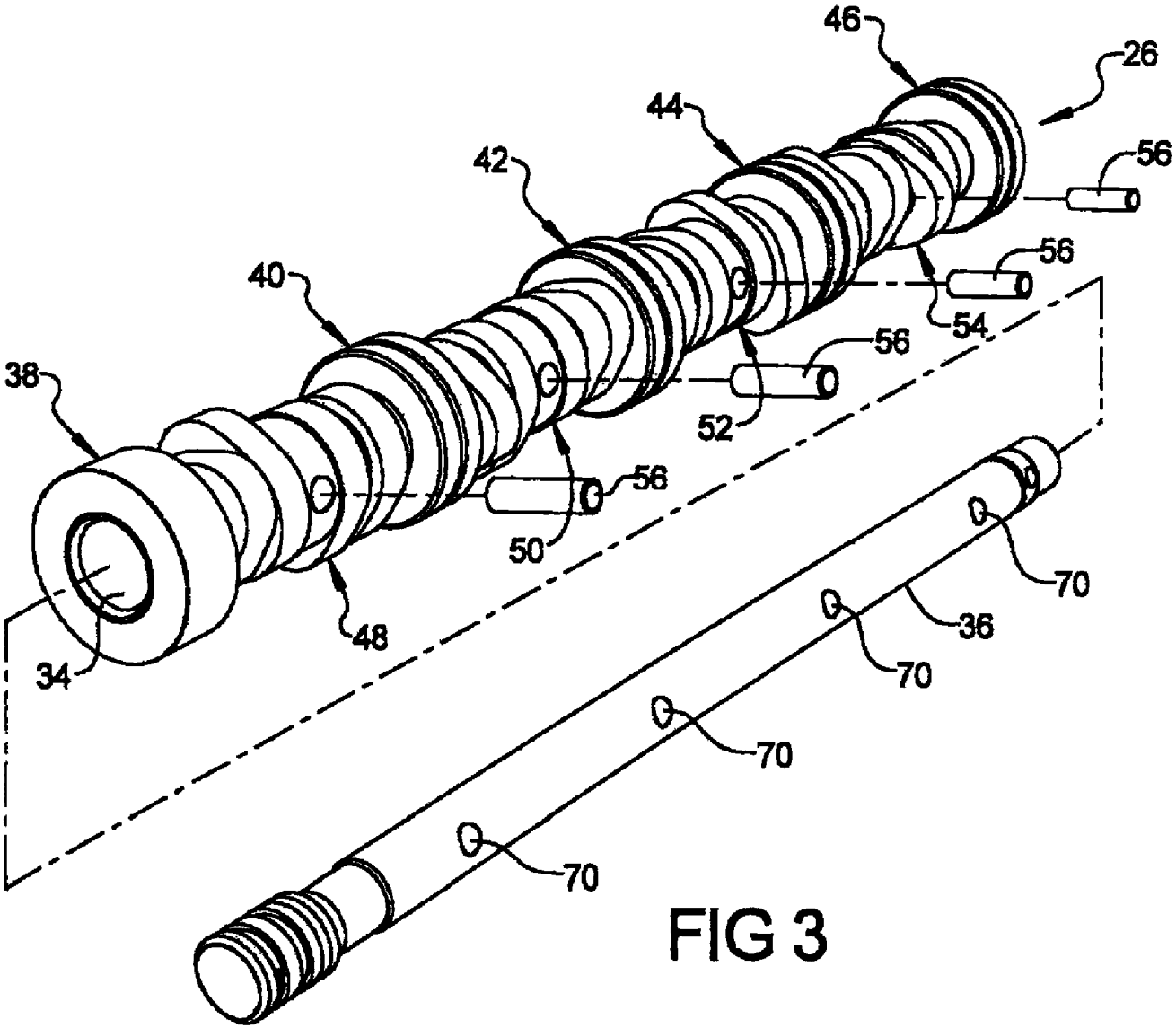
FIG. 3 is a perspective exploded view of the camshaft of FIG. 1.

Referring now to FIG. 1, an exemplary engine assembly 10 is schematically illustrated. The engine assembly 10 may include an engine 12 including a plurality of cylinders 14 having pistons 16 disposed therein. The engine 12 may further include an intake valve 18, an exhaust valve 20, and intake and exhaust valve lift mechanisms 22, 24 for each cylinder 14, as well as a camshaft 26 and a cam phaser 28.

The intake valve lift mechanism 22 may include a pushrod 30 and a rocker arm 32. The exhaust valve lift mechanism 24 may additionally include a pushrod 30 and a rocker arm 32. Pushrods 30 may be engaged with the camshaft 26 to actuate the rocker arms 32 and selectively open the intake and exhaust valves 18, 20. While the engine assembly 10 is illustrated as a pushrod engine, it is understood that the present disclosure is not limited to pushrod engines and may be applicable to a variety of other engine configurations as well, such as overhead cam engines.

With reference to FIGS. 2-5, the camshaft 26 may include first and second shafts 34, 36, a first set of lobe members 38, 40, 42, 44, 46, a second set of lobe members 48, 50, 52, 54, and fasteners 56. In the present example, the first set of lobe members 38, 40, 42, 44, 46 may form an intake lobe set and the second set of lobe members 48, 50, 52, 54 may form an exhaust lobe set. However, it is understood that alternate arrangements may be provided where the first set of lobe members 38, 40, 42, 44, 46 may form an exhaust lobe set and the second set of lobe members 48, 50, 52, 54 may form an intake lobe set. Further, each of the first and second sets of lobe members 38, 40, 42, 44, 46, 48, 50, 52, 54 are not limited to only intake or exhaust valves. For example, the first and second sets of lobe members 38, 40, 42, 44, 46, 48, 50, 52, 54 may each include an intake lobe and/or an exhaust lobe. The first shaft 34 may be fixed for rotation with a first phaser member 58 and the second shaft 36 may be fixed for rotation with a second phaser member 60. The first and second phaser members 58, 60 may be rotatable relative to one another and relative to a rotationally driven member 62 of the phaser 28.

The first shaft 34 may include an annular wall 64 defining an inner bore 66. The second shaft 36 may be rotatably disposed within the inner bore 66 of the first shaft 34. The first shaft 34 may include slots 68 (seen in FIGS. 4 and 5) therethrough and the second shaft 36 may include apertures 70 that receive the fasteners 56 therein and couple the second set of lobe members 48, 50, 52, 54 for rotation with the second shaft 36. The slots 68 may form radial bores through the first shaft 34 and the apertures 70 may form radial bores through the second shaft 36. The slots 68 in the first shaft 34 may generally allow for a rotational travel of the fasteners 56 therein.

The first set of lobe members 38, 40, 42, 44, 46 may be fixed for rotation with the first shaft 34. The engagement between the first set of lobe members 38, 40, 42, 44, 46 and the first shaft 34 may include a friction fit engagement. The second set of lobe members 48, 50, 52, 54 may be disposed between adjacent ones of the first set of lobe members 38, 40, 42, 44, 46. The second set of lobe members 48, 50, 52, 54 may be rotatably disposed on the first shaft 34 and fixed for rotation with the second shaft 36 by the fasteners 56.

Figure 4:
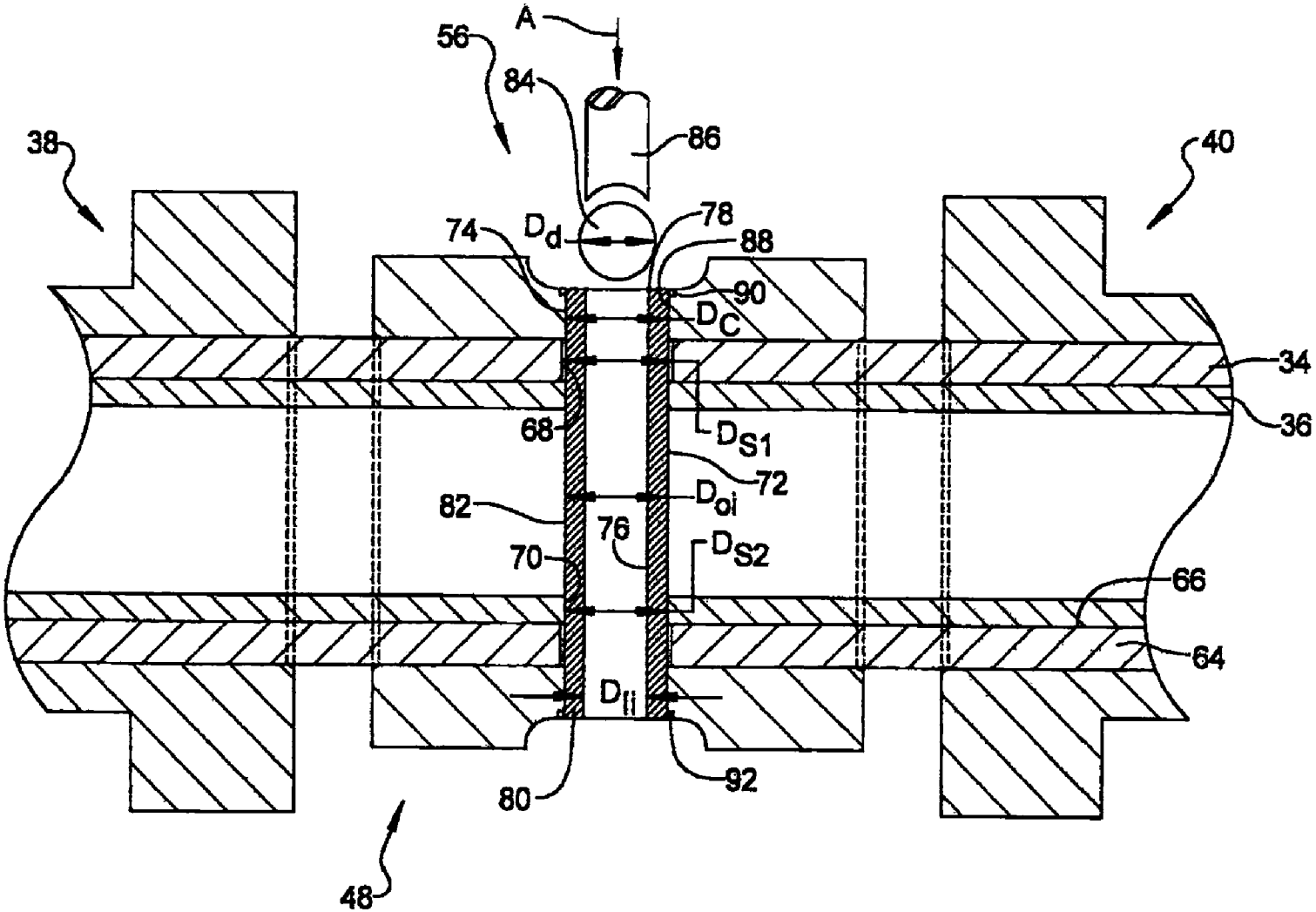
FIG. 4 is a first schematic illustration of a camshaft and a tool assembly according to the present disclosure.
Figure 5:
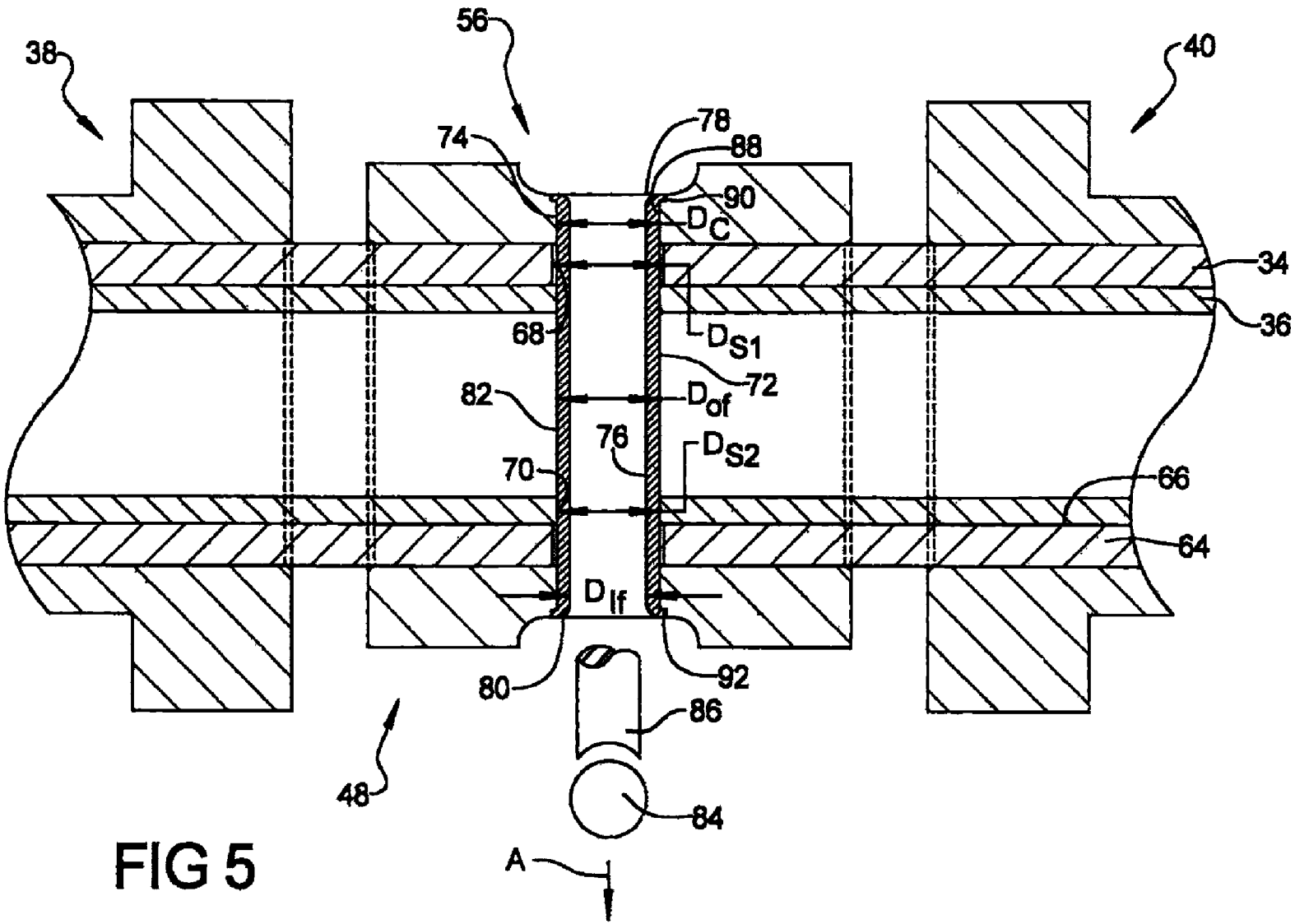
FIG. 5 is a second schematic illustration of the camshaft and tool according to the present disclosure.

As seen in FIGS. 4 and 5, the fasteners 56 may each include a locking pin 72. The locking pin 72 may include an annular wall 74 defining a longitudinal bore 76 extending from a first end 78 of the locking pin 72 to a second end 80 of the locking pin 72. By way of non-limiting example, the locking pin 72 may be in the form of a cylindrical member having a generally circular outer surface 82. The longitudinal bore 76 may also have a generally circular cross-section. A deforming member 84 may be forced through the longitudinal bore 76 of the locking pin 72 to couple the locking pin 72 to the second set of lobe members 48, 50, 52, 54.

A tool 86 may be used to force the deforming member 84 through the longitudinal bore 76 of the locking pin 72. In the non-limiting example shown in FIGS. 4 and 5, the deforming member 84 may be generally spherical, having a diameter ($D_d$). The slots 68 in the first shaft 34 may have an axial width ($D_{S1}$) and the apertures 70 may have a diameter ($D_{S2}$). The axial width ($D_{S1}$) may be greater than the diameter ($D_{S2}$). The second set of lobe members 48, 50, 52, 54 may each include a radial bore 88 defining a diameter ($D_C$). The diameter ($D_C$) may be less than the axial width ($D_{S1}$) and approximately equal to the diameter ($D_{S2}$).

Referring to FIG. 4, the longitudinal bore 76 of the locking pin 72 may have an initial inner diameter ($D_{Ii}$) and an initial outer diameter ($D_{Oi}$). The initial inner diameter ($D_{Ii}$) may be less than the diameter ($D_d$) of the deforming member 84 and the initial outer diameter ($D_{Oi}$) may be less than the diameter ($D_C$) of the radial bore 88 in the lobe member 48. The deforming member 84 may force the annular wall 74 of the locking pin 72 in an outward radial direction as the deforming member is forced through the longitudinal bore 76 in an axial direction (A).

More specifically, the relationship between the diameter ($D_d$) of the deforming member 84 and the initial inner diameter ($D_{Ii}$) of the locking pin 72 may provide the outward radial displacement of the annular wall 74 as the locking pin is advanced axially along the longitudinal bore 76. After the deforming member 84 has been displaced through the longitudinal bore 76, the locking pin 72 may have a final inner diameter ($D_{If}$) and a final outer diameter ($D_{Of}$), as seen in FIG. 5.

The final inner diameter ($D_{If}$) may be approximately equal to the diameter ($D_d$) of the deforming member 84 and the final outer diameter ($D_{Of}$) may be approximately equal to the diameter ($D_C$) of the bore 88 of the lobe member 48. The locking pin 72 may therefore be frictionally engaged with and retained within the bore 88 of the lobe member 48. Additionally, the final outer diameter ($D_{Of}$) of the locking pin 72 may be approximately equal to the diameter ($D_{S2}$) of the aperture 70 in the second shaft 36, fixing the locking pin 72 to the second shaft 36 as well.

After the deforming member 84 is forced through the longitudinal bore 76 of the locking pin 72, the locking pin 72 may be fixed relative to the lobe member 48. The locking pin 72 may remain hollow after being fixed to the lobe member 48. Additionally, the first and second ends 78, 80 of the locking pin 72 may be swaged, or deformed in an outward radial direction, to further fix the locking pin 72 relative to the lobe member 48. More specifically, the first and second ends 78, 80 may be displaced radially outward from the bore 88 of the lobe member 48 and into counter bores 90, 92.

It is understood that the fastener 56 is shown in combination with the lobe member 48 in FIGS. 4 and 5 for simplicity and the description applies equally to the remainder of the second set of lobe members 50, 52, 54.

What is claimed is:

1. A method comprising:

locating a first lobe member of a camshaft assembly on a first shaft of the camshaft assembly;

inserting a locking pin into a first radial bore in the first lobe member and a second radial bore of the first shaft, the locking pin having an annular wall defining a pin bore extending from a first end of the locking pin to a second end of the locking pin; and forcing a deforming member into the pin bore and displacing the annular wall in an outward radial direction and into a frictional engagement with the first radial bore, the forcing including the deforming member entering the pin bore at the first end of the locking pin and exiting the pin bore at the second end of the locking pin, the frictional engagement between the locking pin and the first lobe member fixing the locking pin to the first lobe member.

2. The method of claim 1, further comprising deforming the first end of the locking pin in an outward radial direction outward from the first radial bore after the forcing.

3. The method of claim 1, wherein the deforming member includes a generally spherical member.

4. The method of claim 1, wherein the locking pin is hollow after the forcing.

5. The method of claim 1, wherein the camshaft assembly includes a second shaft, the first shaft defining an axial bore and the second shaft being located within the axial bore, the lobe member being rotatably disposed on an outer radial surface of the first shaft and fixed for rotation with the second shaft through an engagement between the locking pin and the second shaft.

6. The method of claim 5, wherein the second shaft includes a third radial bore, the forcing displacing the annular wall in an outward radial direction and into a frictional engagement with the third radial bore.

7. The method of claim 6, wherein the second radial bore has an axial width greater than an outer diameter of the locking pin located within the second radial bore after the forcing.

8. The method of claim 1, wherein the pin bore has an inner diameter less than an outer diameter of the deforming member before the forcing.

9. The method of claim 1, wherein the locking pin includes a generally cylindrical body.

10. The method of claim 9, wherein the pin bore has a generally circular cross-section.

11. A method comprising:

locating a first lobe member of a camshaft assembly on a first shaft of the camshaft assembly;

inserting a locking pin into a first radial bore in the first lobe member and a second radial bore of the first shaft, the locking pin having an annular wall defining a pin bore extending from a first end of the locking pin to a second end of the locking pin; and forcing a deforming member into the pin bore and displacing the annular wall in an outward radial direction and into a frictional engagement with the first radial bore, the locking pin being hollow after the forcing and the frictional engagement between the locking pin and the first lobe member fixing the locking pin to the first lobe member.

12. The method of claim 11, wherein the camshaft assembly includes a second shaft, the first shaft defining an axial bore and the second shaft being located within the axial bore, the lobe member being rotatably disposed on an outer radial surface of the first shaft and fixed for rotation with the second shaft through an engagement between the locking pin and the second shaft.

13. The method of claim 12, wherein the second radial bore has an axial width greater than an outer diameter of the locking pin located within the second radial bore after the forcing.

14. A camshaft assembly comprising:

a first shaft including a first radial bore;

a first lobe member located on the first shaft and including a second radial bore aligned with the first radial bore; and a locking pin located within the first and second radial bores, the locking pin including an annular body defining a generally hollow longitudinal bore extending from a first longitudinal end of the locking pin to a second longitudinal end of the locking pin, the first and second longitudinal ends being frictionally engaged with the first lobe member and fixing the locking pin to the first lobe member.

15. The camshaft assembly of claim 14, wherein the first longitudinal end of the locking pin extends radially outward relative to the second radial bore at the first longitudinal end.

16. The camshaft assembly of claim 14, wherein the locking pin has an outer diameter less than an inner diameter of the first radial bore.

17. The camshaft assembly of claim 14, wherein the locking pin is generally cylindrical.

18. The camshaft assembly of claim 14, wherein the longitudinal bore of the locking pin has a generally circular cross-section.

19. The camshaft assembly of claim 14, further comprising a second shaft, the first shaft including an axial bore and the second shaft being located within the axial bore and including a third radial bore aligned with the first and second radial bores and receiving the locking pin therein, the first lobe member being rotatably disposed on the first shaft and being fixed for rotation with the second shaft through an engagement with the locking pin.

20. The camshaft assembly of claim 19, wherein the third radial bore has a diameter generally equal to a diameter of the second radial bore.

* * * * *